United States Patent [19]

Ueno et al.

[11] Patent Number: 4,483,288

[45] Date of Patent: Nov. 20, 1984

[54] SPLIT ENGINE

[75] Inventors: Makoto Ueno, Shizuoka; Kohei Hori, Susono, both of Japan

[73] Assignee: Toyota Jidosha Kabushiki Kaisha, Toyota, Japan

[21] Appl. No.: 475,484

[22] Filed: Mar. 15, 1983

[30] Foreign Application Priority Data

Oct. 18, 1982 [JP] Japan ..... 57-181465

[51] Int. Cl.[3] ..... F02D 17/02

[52] U.S. Cl. ..... 123/198 F; 123/481

[58] Field of Search ..... 123/198 F, 481

[56] References Cited

U.S. PATENT DOCUMENTS

| | | | |
|---|---|---|---|
| 4,192,278 | 3/1980 | Iizuka et al. | 123/198 F |
| 4,204,514 | 5/1980 | Ishida | 123/481 |
| 4,257,372 | 3/1981 | Etoh et al. | 123/198 F |
| 4,308,831 | 1/1982 | Sugasawa et al. | 123/198 F |
| 4,337,740 | 7/1982 | Sugasawa et al. | 123/198 F |
| 4,364,345 | 12/1982 | Tsutsumi et al. | 123/198 F |
| 4,366,788 | 1/1983 | Tanaka et al. | 123/198 F |

FOREIGN PATENT DOCUMENTS 55-69736 5/1980 Japan .

*Primary Examiner*—Ira S. Lazarus

*Attorney, Agent, or Firm*—Finnegan, Henderson, Farabow, Garrett & Dunner

[57] ABSTRACT

A split engine comprising a plurality of cylinders divided into a first cylinder group and a second cylinder group. The second cylinder group is connected to the outside air via a second surge tank. The first cylinder group is connected to the second surge tank via a first surge tank. A shut-off valve is arranged in the connecting portion of the first surge tank and the second surge tank. When the level of the load of the engine becomes higher than a predetermined level, the shut-off valve is slowly opened by a DC motor.

17 Claims, 10 Drawing Figures

39
38
37
51
50
42
27
22
23
29
28
13b
13a
12
17b
10
A
B
11
61
54
17a
53
14
16a
16b
16c
16d
16e
16f
15
19
20

| Fig. 4A |
| --- |
| Fig. 4B |

SPLIT ENGINE

BACKGROUND OF THE INVENTION

The present invention relates to a split engine.

In an internal-combustion engine in which the load of the engine is controlled by a throttle valve, a specific fuel consumption deteriorates as the degree of opening of the throttle valve is reduced. Consequently, in order to improve the specific fuel consumption, a split engine as disclosed in Japanese Unexamined Patent Publication (Kokai) No. 55-69736 has been devised in which, when the engine is operating under a light load, part of the cylinders of the engine are not fired while the remaining cylinders operate under a heavy load. As is illustrated in FIG. 1, in this type of engine, the cylinders are divided into a first cylinder group A and a second cylinder group B, and a first intake manifold 1 and a second intake manifold 2 are connected to the first cylinder group A and the second cylinder group B, respectively. The first intake manifold 1 and the second intake manifold 2 are connected to the outside air via a common throttle valve 3, and a shut-off valve 4 is arranged in the air inlet of the first intake manifold 1. The first intake manifold 1 and an exhaust manifold 5 are interconnected to each other via an exhaust-gas recirculation passage 6, and a recirculation control valve 7 is arranged in the exhaust-gas recirculation passage 6. In the split engine, when the engine is operating under a light load, the injection of fuel by fuel injectors 8 is stopped, and the shut-off valve 4 is closed. In addition, the recirculation control valve 7 is open, and the cylinders of the second cylinder group B operate under a heavy load. Contrary to this, when the engine is operating under a heavy load, the shut-off valve 4 is open, and the recirculation control valve 7 is closed. In addition, fuel is injected by all of the fuel injectors 8 and 9, and, thus, all of the cylinders are fired.

As mentioned above, when the engine is operating under a light load, the shut-off valve 4 is closed, and the recirculation control valve 7 is open. As a result, since the exhaust gas is recirculated into the first cylinder group A via the exhaust-gas recirculation passage 6, it is possible to prevent pumping loss in the first cylinder group A from occurring. In addition, at this time, since the cylinders of the second cylinder group B operate under a heavy load, it is possible to improve the specific fuel consumption.

In such a split engine, however, at the time of changing the number of cylinders to be fired, control of the engine is the most difficult and various problems occur. For example, in the split engine illustrated in FIG. 1, when the operating state of the engine is changed from a light load to a heavy load, the recirculation control valve 7 opens to the maximum extent. Then, the shut-off valve 4 abruptly opens, and the supply of fuel into the first cylinder group A is started. However, at this time, since the shut-off valve 4 abruptly opens as mentioned above, the output torque of the first cylinder group A is abruptly increased and, thus, a problem occurs in that the drivability of a vehicle deteriorates.

SUMMARY OF THE INVENTION

An object of the present invention is to provide a split engine capable of slowly opening and closing the shut-off valve.

According to the present invention, there is provided a split engine having a plurality of cylinders which are divided into a first cylinder group and a second cylinder group, said engine comprising: a first intake passage having an inlet and an outlet connected to said first cylinder group; a second intake passage having an inlet and an outlet connected to said second cylinder group, the inlet of said first intake passage being connected to said second intake passage and the inlet of said second intake passage being open to the outside air; an exhaust passage connected to said first cylinder group; a manually operated throttle valve arranged in the inlet of said second intake passage; detecting means for detecting the level of the load of the engine and for producing an output signal; electronic control means for producing control signals in response to the output signal of said detecting means; fuel supply means, actuated in response to a control signal of said electronic control means, for feeding fuel into only said second cylinder group when the level of the load of the engine is lower than a predetermined level and for feeding fuel into both of said cylinder groups when the level of the load of the engine is higher than the predetermined level; an exhaust-gas recirculation passage interconnecting said exhaust passage to said first intake passage; a recirculation control valve, arranged in said exhaust-gas recirculation passage, for controlling the flow area of said exhaust-gas recirculation passage; actuating means operated in response to a control signal of said electronic control means and opening said recirculation control valve when the level of the load of the engine is lower than the predetermined level; a shut-off valve, arranged in the inlet of said first intake passage, for controlling the flow area of the inlet of said first intake passage; and a drive apparatus operated in response to a control signal of said electronic control means and having therein a DC motor which actuates said shut-off valve for opening it when the level of the load of the engine becomes higher than the predetermined level.

The present invention may be more fully understood from the description of a preferred embodiment of the invention, set forth below, together with the accompanying drawings.

DESCRIPTION OF THE PREFERRED EMBODIMENT

Figure 1:
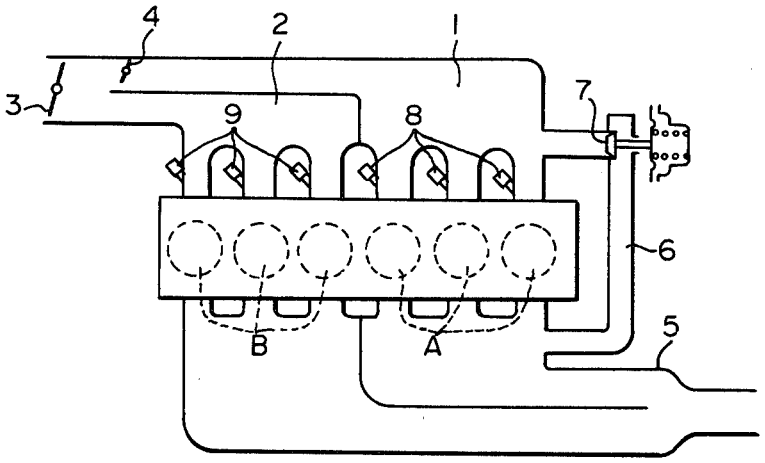
Fig. 1 PRIOR ART
FIG. 1 is a schematically illustrated plan view of a prior art engine.
Figure 2:
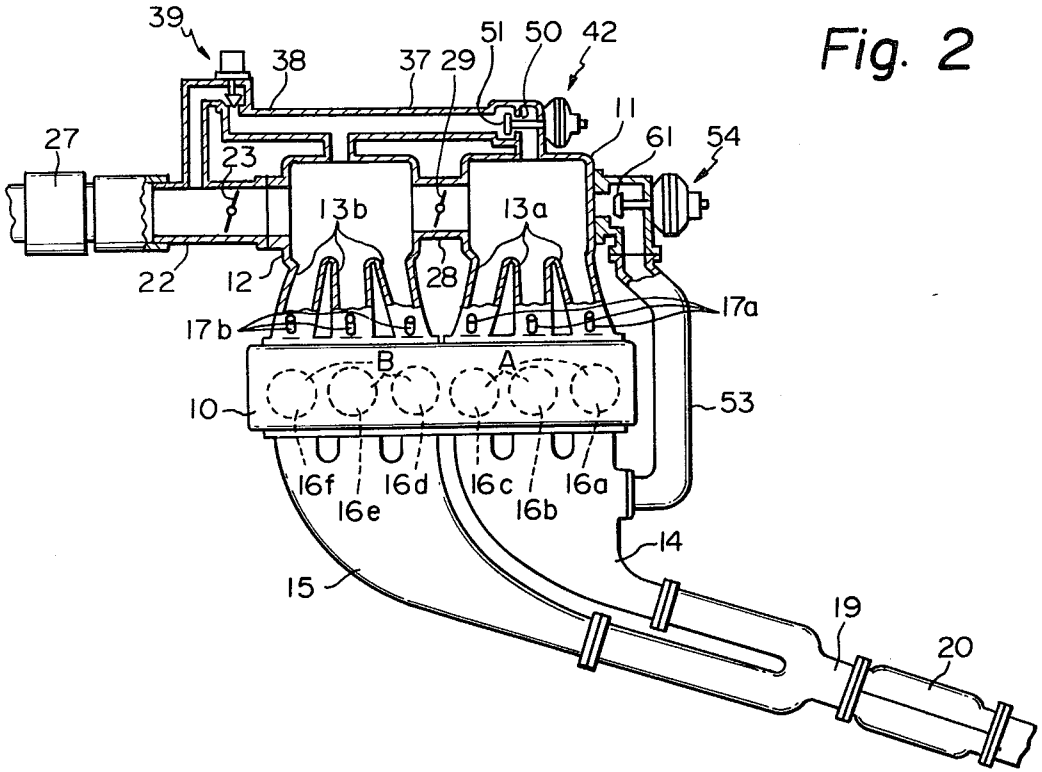
FIG. 2 is a plan view of an engine according to the present invention.

Referring to FIG. 2, reference numeral 10 designates an engine body, 11 a first surge tank, 12 a second surge tank, and 13*a* separate first pipes connected to the first surge tank 11; 13*b* designates separate second pipes connected to the second surge tank 12, 14 a first exhaust manifold, and 15 a second exhaust manifold; and 16*a*, 16*b*, 16*c*, 16*d*, 16*e*, and 16*f* designate a No. 1 cylinder, a No. 2 cylinder, a No. 3 cylinder, a No. 4 cylinder, a No. 5 cylinder, and a No. 6 cylinder, respectively. The cylinders 16*a*, 16*b*, 16*c*, 16*d*, 16*e*, and 16*f* are divided into a first cylinder group A consisting of the cylinders 16*a*, 16*b*, and 16*c* and a second cylinder group B consisting of the cylinders 16*d*, 16*e*, and 16*f*.

As is illustrated in FIG. 2, the first surge tank 11 and the first exhaust manifold 14 are connected to the first cylinder group A, and the second surge tank 12 and the second exhaust manifold 15 are connected to the second cylinder group B.

Figure 3:
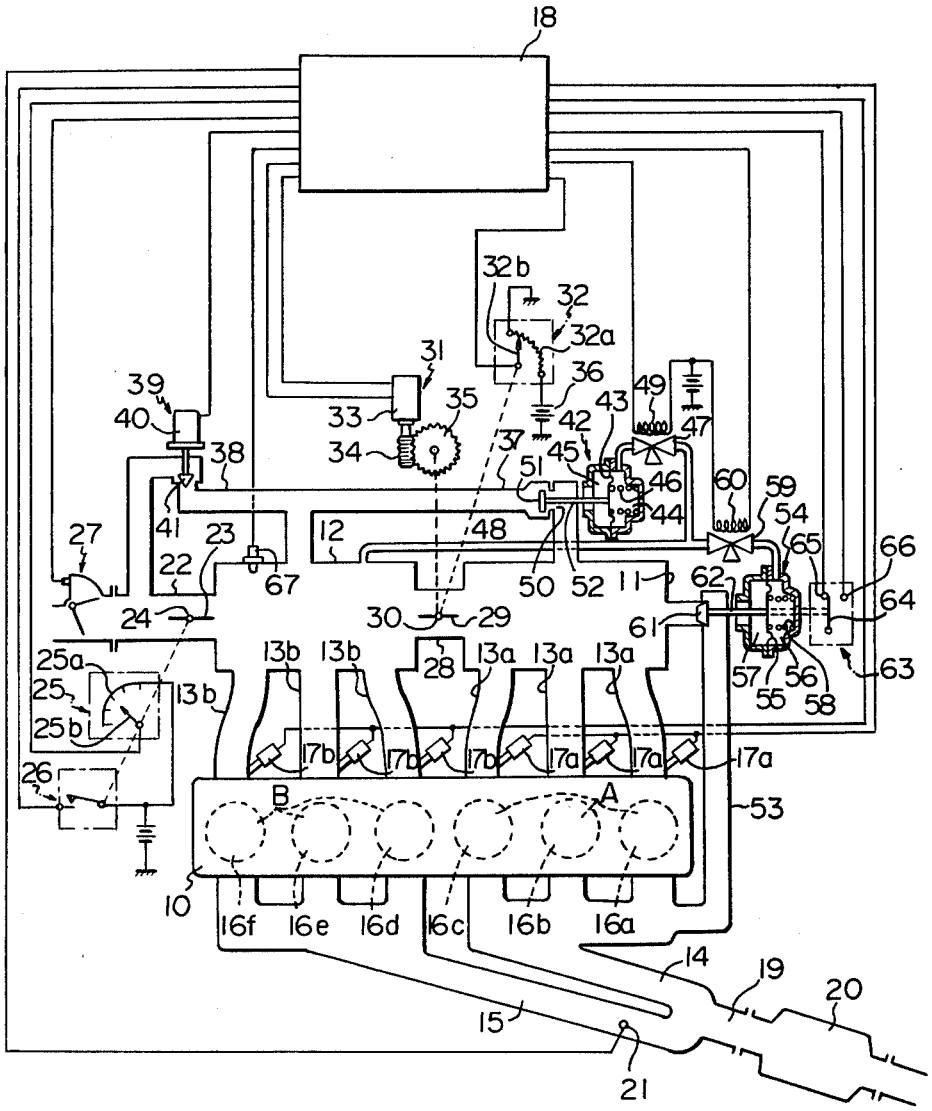
FIG. 3 is a schematically illustrated plan view of the engine illustrated in FIG. 2.

As is illustrated in FIGS. 2 and 3, fuel injectors 17*a* are mounted on first pipes 13*a* of the first surge tank 11, and fuel injectors 17*b* are mounted on second pipes 13*b* of the second surge tank 12. The solenoids of the fuel injectors 17*a* and 17*b* are connected to an electronic control unit 18. The first exhaust manifold 14 and the second exhaust manifold 15 are joined to each other and are connected to a single collection pipe 19. The outlet of the collection pipe 19 is connected to a three-way catalytic converter 20.

As is illustrated in FIG. 3, an oxygen concentration detector 21 (hereinafter referred to as an $O_2$ sensor) is arranged in the second exhaust manifold 15 and is connected to the electronic control unit 18. An intake duct 22 is attached to the second surge tank 12, and a throttle valve 23 is arranged in the intake duct 22. The throttle valve 23 is connected to the accelerator (not shown). A throttle sensor 25 and an idle switch 26 are connected to a valve shaft 24 of the throttle valve 23. The throttle sensor 25 comprises a comb-shaped stationary terminal 25*a* and a rotary terminal 25*b*, which is rotatable together with the throttle valve 23. The throttle sensor 25 produces an output signal every each time the rotary terminal 25*b* faces one of the teeth of the comb-shaped stationary terminal 25*a*. Consequently, as the opening speed or the closing speed of the throttle valve 23 is increased, the time interval of the generation of the output signals of the throttle sensor 25 becomes short, and, thus, the opening speed and the closing speed of the throttle valve 23 can be calculated from the output signals of the throttle sensor 25. The idle switch 26 is turned on when the throttle valve 23 is at idle. The throttle sensor 25 and the idle switch 26 are connected to the electronic control unit 18. An airflow meter 27 is attached to the inlet of the intake duct 22 and is connected to the electronic control unit 18.

The first surge tank 11 and the second surge tank 12 are interconnected to each other via a connecting pipe 28, which is formed in one piece thereon, and a shut-off valve 29 is arranged in the connecting pipe 28. The valve shaft 30 of the shut-off valve 29 is connected, on the one hand, to a drive apparatus 31 and, on the other hand, to a valve position sensor 32. The drive apparatus 31 comprises a DC motor 33, a worm gear 34 fixed to the drive shaft of the DC motor 33, and a worm wheel 35 engaging with the worm gear 34 and fixed to the valve shaft 30 of the shut-off valve 29. Consequently, it is understood that when the DC motor 33 is operated, the shut-off valve 29 is rotated.

The valve position sensor 32 comprises a stationary resistor 32*a* and a movable contact 32*b*, which rotates together with the shut-off valve 29 while contacting the stationary resistor 32*a*. One end of the stationary resistor 32*a* is connected to a power source 36, and the other end of the stationary resistor 32*a* is grounded. Consequently, it is understood that the voltage, which is proportional to the degree of opening of the shut-off valve 29, is produced at the movable contact 32*b*. The DC motor 33 and the valve position sensor 32 are connected to the electronic control unit 18.

The first surge tank 11 is also connected to the second surge tank 12 via a bypass pipe 37. In addition, the bypass pipe 37 is connected via an auxiliary air supply pipe 38 to the interior of the intake duct 22 at a position located upstream of the throttle valve 23. A valve unit 39 for controlling the idle speed of the engine is arranged in the auxiliary air supply pipe 38. The valve unit 39 comprises a stepping motor 40 actuated in response to the output signal of the electronic control unit 18 and a flow-control valve 41 driven by the stepping motor 40.

When the engine is idling, the amount of air flowing within the auxiliary air supply pipe 38 is controlled by the flow-control valve 41 so that the idle speed of the engine is kept constant. A bypass control valve apparatus 42 is arranged in the bypass pipe 37. The bypass control valve apparatus 42 comprises a vacuum chamber 44 and an atmospheric pressure chamber 45 which are separated by a diaphragm 43, and a compression spring 46 for biasing the diaphragm 43 is inserted in the vacuum chamber 44. The vacuum chamber 44 is connected to the second surge tank 12 via a first electromagnetic valve 47 and a vacuum conduit 48. In addition, the solenoid 49 of the first electromagnetic valve 47 is connected to the electronic control unit 18. A valve port 50 is formed in the bypass pipe 37, and a valve body 51 for controlling the opening operation of the valve port 50 is arranged in the bypass pipe 37. The valve body 51 is connected to the diaphragm 43 via a valve rod 52.

The first exhaust manifold 14 and the first surge tank 11 are interconnected to each other via an exhaust-gas recirculation passage 53, and a recirculation control valve 54 is arranged in the exhaust-gas recirculation passage 53. The recirculation control valve 54 comprises a vacuum chamber 56 and an atmospheric pressure chamber 57, which are separated by a diaphragm 55, and a compression spring 58 for biasing the diaphragm 55 is inserted in the vacuum chamber 56. The vacuum chamber 56 is connected to the second surge tank 12 via a second electromagnetic valve 59 and the vacuum conduit 48, and the solenoid 60 of the second electromagnetic valve 59 is connected to the electronic control unit 18. A valve body 61 for controlling the flow area of the exhaust-gas recirculation passage 53 is arranged in the exhaust-gas recirculation passage 53 and is connected to the diaphragm 55 via a valve rod 62. In addition, the recirculation control valve 54 is provided with a valve position switch 63. The valve position switch 63 comprises a movable contact 64 connected to the diaphragm 55 and actuated by it and a pair of stationary contacts 65 and 66 which are able to contact the movable contact 64. The stationary contacts 65 and 66 are connected to the electronic control unit 18. The movable contact 64 is connected to the stationary contact 65 when the valve body 61 closes and is connected to the stationary contact 66 when the valve body 61 opens.

As is illustrated in FIG. 3, a vacuum sensor 67 for detecting the level of the load of the engine is arranged in the second surge tank 12 and is connected to the electronic control unit 18. In addition, in order to detect the engine speed, a speed sensor 72 (FIG. 4) is mounted on the engine body 10.

Figures 4, 4A:
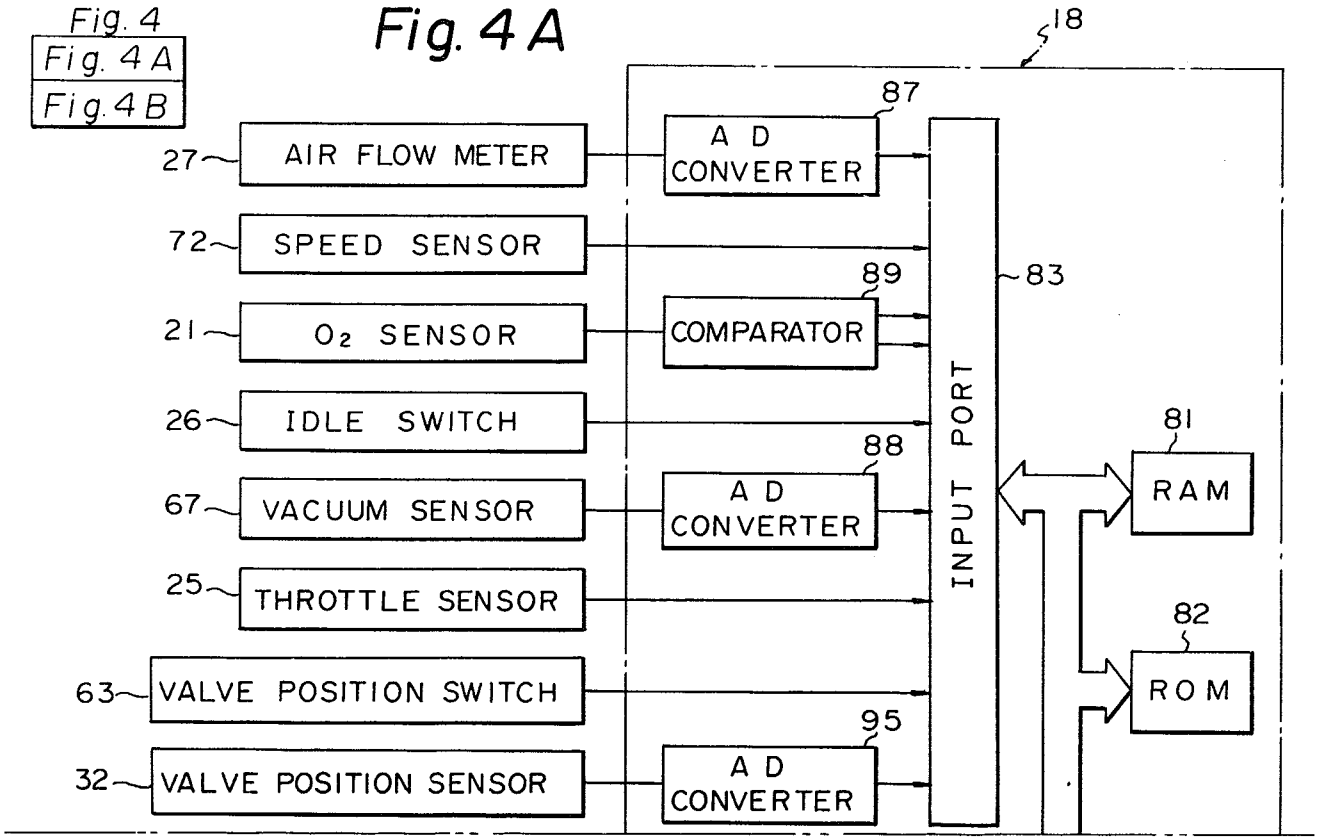
FIG. 4 (4A and 4B) is a circuit diagram of the electronic control unit illustrated in FIG. 3.
Figure 4B:
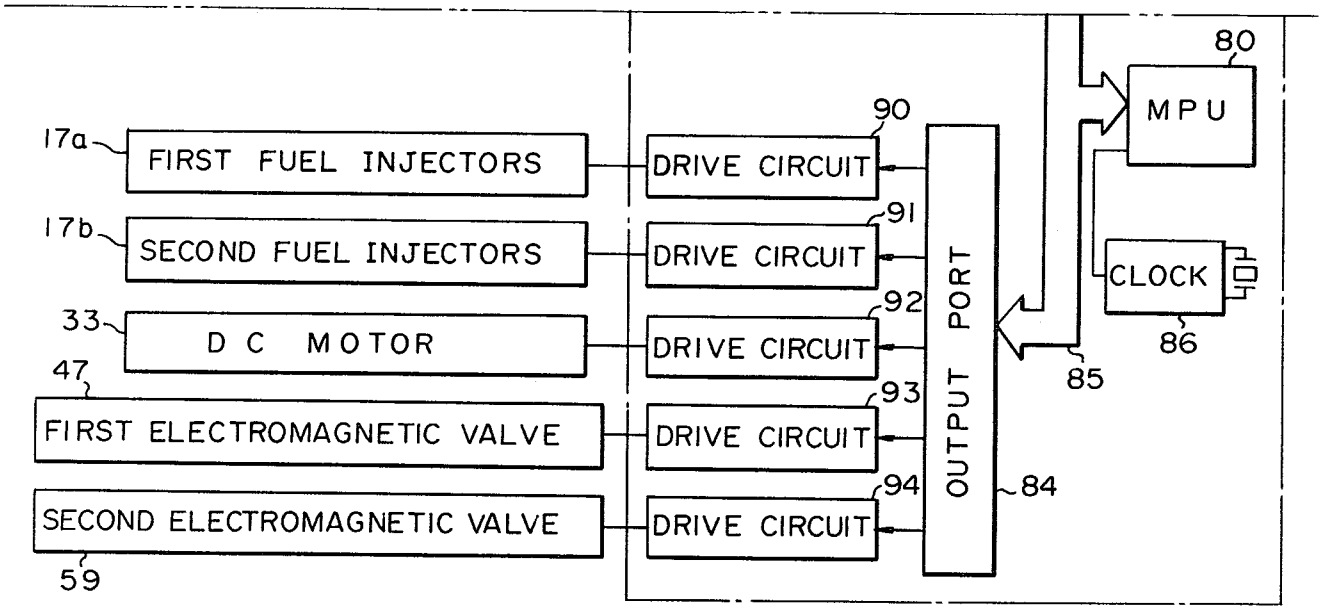

FIGS. 4A and 4B, illustrate the electronic control unit 18. Referring to FIGS. 4A and 4B, the electronic control unit 18 is constructed as digital computer and comprises a microprocessing unit (MPU) 80 for carrying out arithmetic and logic processing, a random-access memory (RAM) 81, a read-only memory (ROM) 82 for storing a predetermined control program and an arithmetic constant therein, an input port 83, and an output port 84. The MPU 80, the RAM 81, the ROM 82, the input port 83, and the output port 84 are interconnected to each other via a bidirectional bus 85. In addition, the electronic control unit 18 comprises a clock generator 86 for generating various clock signals.

As is illustrated in FIGS. 4A and 4B, the speed sensor 72, the idle switch 26, the throttle sensor 25, and the valve position switch 63 are connected to the input port 83. The airflow meter 27, the vacuum sensor 67, and the valve position sensor 32 are connected to the input port 83 via corresponding AD converters 87, 88, and 95 and the $O_2$ sensor 21 is connected to the input port 83 via a comparator 89.

The airflow meter 27 produces an output voltage which is proportional to the amount of air fed into the intake duct 22. The output voltage of the airflow meter 27 is converted into the corresponding binary code in the AD converter 87 and then the binary code is input into the MPU 80 via the input port 83 and the bus 85. The speed sensor 72 produces continuous pulses at a frequency which is proportional to the engine speed, and the continuous pulses are input into the MPU 80 via the input port 83 and the bus 85. The $O_2$ sensor 21 produces an output voltage of about 0.1 volts when the air-fuel ratio of the fuel mixture fed into the second cylinder group B becomes larger than the stoichiometric air-fuel ratio and produces an output voltage of about 0.9 volts when the air-fuel ratio of the fuel mixture fed into the second cylinder group B becomes smaller than the stoichiometric air-fuel ratio.

The output voltage of the $O_2$ sensor 21 is compared with a reference voltage of about 0.5 volts in the comparator 89. At this time, if the air-fuel ratio of the fuel mixture is larger than the stoichiometric air-fuel ratio, an output signal is produced at one of the output terminals of the comparator 89, and if the air-fuel ratio of the fuel mixture is smaller than the stoichiometric air-fuel ratio, an output signal is produced at the other output terminal of the comparator 89. The output signal of the comparator 89 is input into the MPU 80 via the input port 83 and the bus 85.

The vacuum sensor 67 produces an output voltage which is proportional to the level of vacuum in the second surge tank 12. The output voltage of the vacuum sensor 67 is converted to the corresponding binary code in the AD converter 88 and then the binary code is input into the MPU 80 via the input port 83 and the bus 85.

The valve position sensor 32 produces an output voltage which is proportional to the degree of the opening of the shut-off valve 29. The output voltage of the valve position sensor 32 is converted to the corresponding binary code in the AD converter 95 and then the binary code is input into the MPU 80 via the input port 83 and the bus 85. In addition, the output signals of the idle switch 26, the throttle sensor 25, and the valve position switch 63 are input into the MPU 80 via the input port 83 and the bus 85.

The first fuel injectors 17*a*, the second fuel injectors 17*b*, the DC motor 33, the first electromagnetic valve 47, and the second electromagnetic valve 59 are connected to the output port 84 via corresponding drive circuits 90, 91, 92, 93, and 94. Data for actuating the first fuel injectors 17*a*, the second fuel injectors 17*b*, the DC motor 33, the first electromagnetic valve 47, and the second electromagnetic valve 59 is written into the output port 84.

Figure 7:
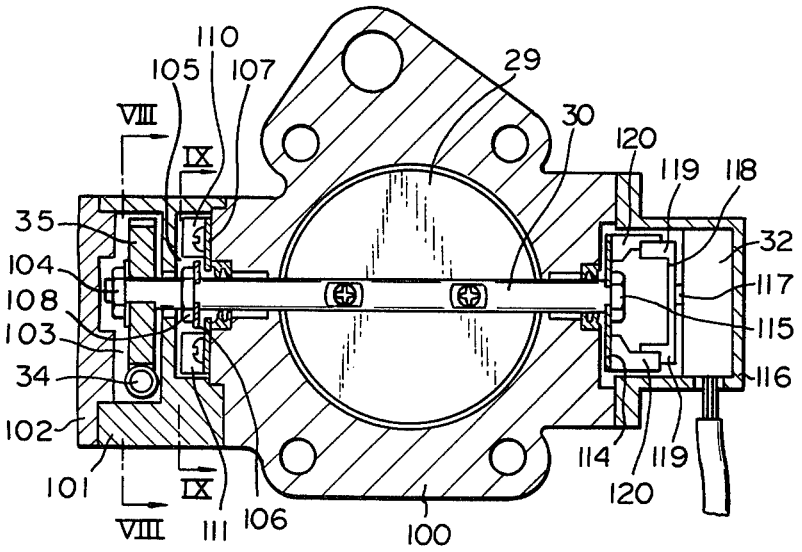
FIG. 7 is a cross-sectional side view a shut-off valve apparatus.
Figure 8:
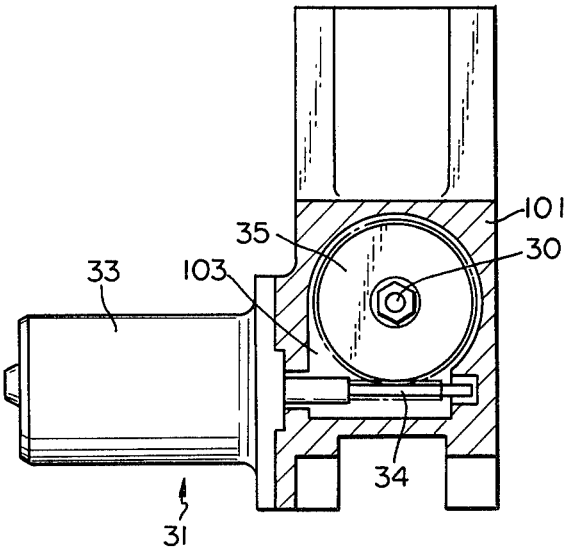
FIG. 8 is a cross-sectional view taken along the line VIII—VIII in FIG. 7.
Figure 9:
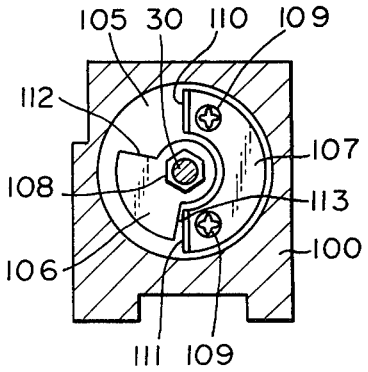
FIG. 9 is a cross-sectional view taken along the line IX—XI in FIG. 7.

FIGS. 7 through 9 illustrate the drive apparatus 31 and the shut-off valve 29 illustrated in FIG. 3. Referring to FIGS. 7 through 9, the valve shaft 30 of the shut-off valve 29 is supported by a housing 100 which forms a portion of the connecting pipe 28 (FIG. 3), and the opposed ends of the valve shaft 30 project outwardly from the housing 100. One end of the valve shaft 30 extends through a drive apparatus housing 101 having an I-shaped cross section and being fixed to the housing 100, and the outer side of the housing 101 is covered by a cover member 102. The worm wheel 35 is arranged in the interior space 103 formed between the housing 101 and the cover member 102 and is fixed to the valve shaft 30 with a nut 104. In addition, the DC motor 33 is fixed to the housing 101, and the worm gear 34, engaging with the worm wheel 35, is fixed to the drive shaft of the DC motor 33. The worm gear 34 and the worm wheel 35 together form a reduction gear.

As is illustrated in FIGS. 7 and 9, an arm 106 and a stop member 107 are arranged in the interior space 105 formed between the housings 101 and 100. The arm 106 has a sector shape and is fixed to the valve shaft 30 with a nut 108. The stop member 107 has an approximately semicircular shape and is fixed to the housing 100 with a pair of bolts 109. The stop member 107 has at its opposing ends end portions 110 and 111, which are outwardly bent and are arranged so that they are engageable with the sector-shaped arm 106.

The sector-shaped arm 106 and the stop member 107 serve to determine the wide open position and the closed position of the shut-off valve 29. That is, when the end face 112 of the arm 106 abuts against the bent end portion 110, the shut-off valve 29 is in the wide open position and when the end face 113 of the arm 106 abuts against the bent end portion 111, the shut-off valve 29 is in the closed position.

As is illustrated in FIG. 7, an arm 114 is fixed to the end portion of the valve shaft 30, which end portion is located opposite the worm wheel 35, with a nut 115. The arm 114 is covered by a cover member 116 fixed to the housing 100, and the valve position sensor 32 is arranged in the cover member 116. An arm 118 is fixed to a rotary shaft 117 of the valve position sensor 32 and has projecting end portions 119 at the opposed ends thereof. In addition, the arm 114 has, at its opposed ends, projecting end portions 120 which engage with the projecting end portions 119. Consequently, rotation of the valve shaft 30 causes rotation of the rotary shaft 117 of the valve position sensor 32, and, thus, the position of the shut-off valve 29 can be detected by the valve position sensor 32.

As illustrated in FIG. 7, the DC motor 33, the worm gear 34, the worm wheel 35, the arm 106, the stop member 107, and the valve position sensor 32 are integrally assembled into the housing 100. This makes it possible to minimize the size of the drive apparatus 31.

Figure 5:
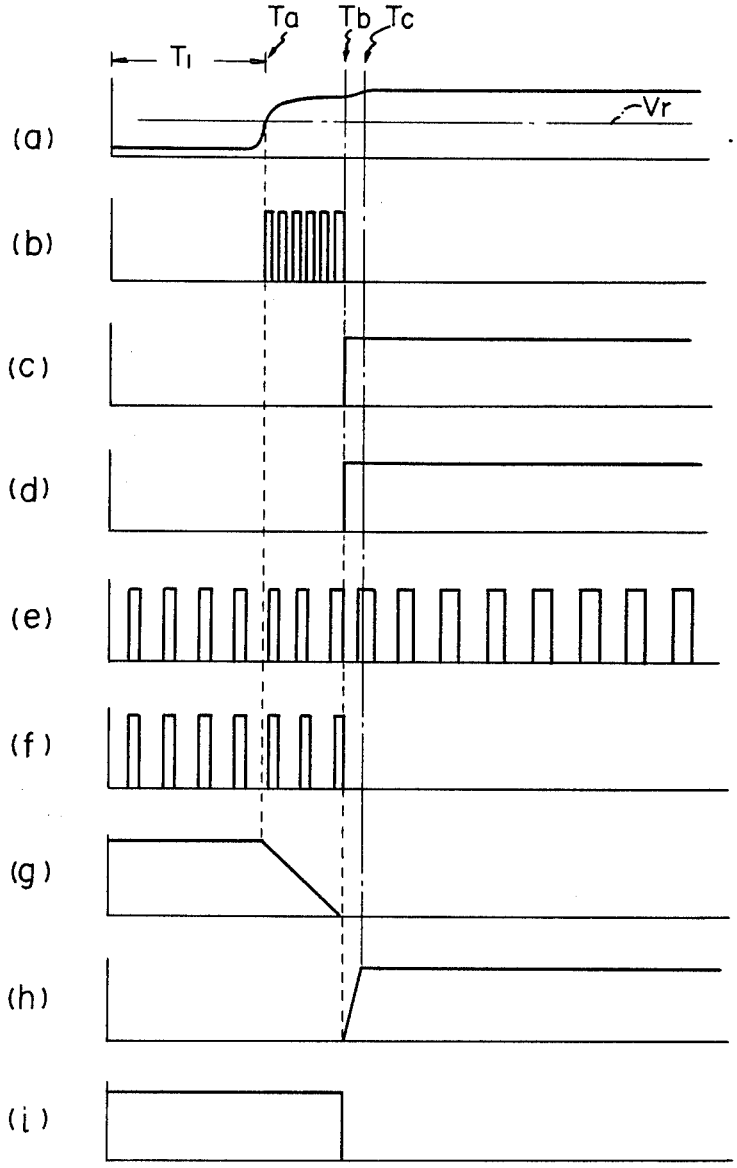
FIG. 5 is a diagram illustrating the control method according to the present invention.
Figure 6:
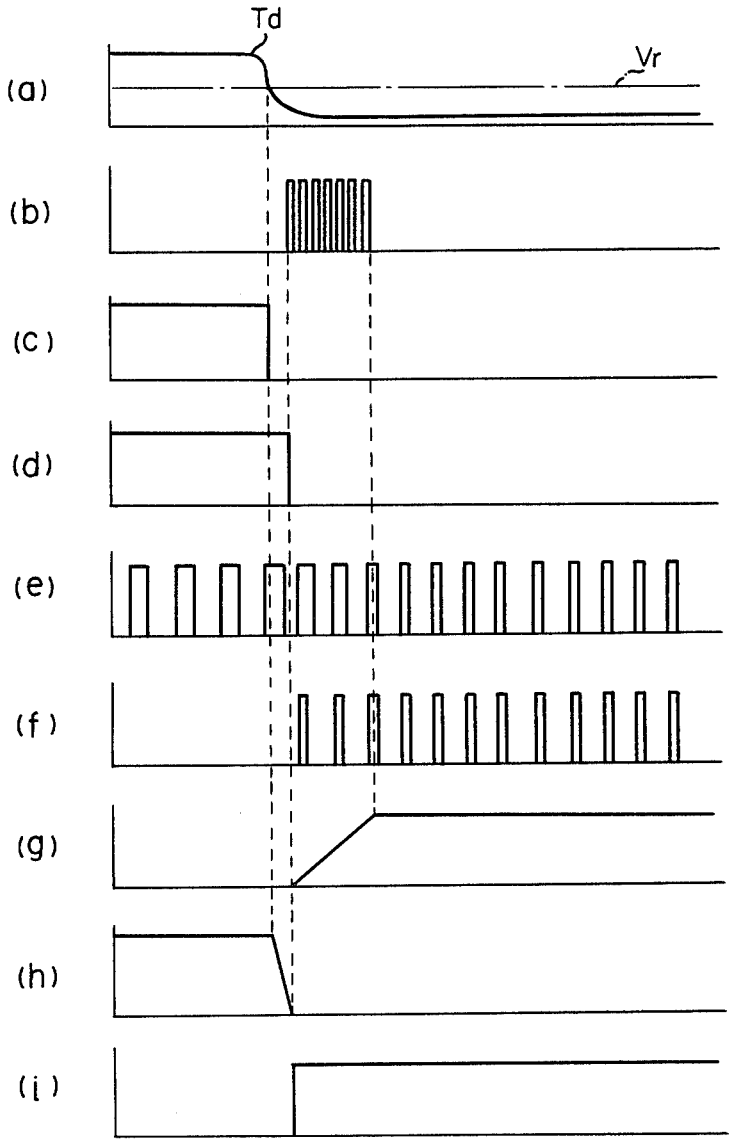
FIG. 6 is a diagram also illustrating the control method according to the present invention.

FIGS. 5 and 6 illustrate the operation of the split engine according to the present invention.

In FIGS. 5 and 6:

(a) indicates the output voltage of the vacuum sensor 67.
(b) indicates a drive pulse supplied to the DC motor 33.
(c) indicates a control voltage supplied to the solenoid 60 of the second electromagnetic valve 59.
(d) indicates a control voltage supplied to the solenoid 49 of the first electromagnetic valve 47.
(e) indicates a control pulse supplied to the fuel injectors 17*b* of the second cylinder group B.
(f) indicates a control pulse supplied to the fuel injectors 17*a* of the first cylinder group A.
(g) indicates the degree of opening of the shut-off valve 29.
(h) indicates the degree of opening of the valve body 61 of the recirculation control valve 54.
(i) indicates the degree of opening of the valve body 51 of the bypass control valve apparatus 42.

FIG. 5 illustrates a case wherein the operating state of the engine is changed from a heavy load to a light load, and FIG. 6 illustrates a case wherein the operating state of the engine is changed from a light load to a heavy load.

In FIG. 5, section $T_1$ indicates a state where the output voltage of the vacuum sensor 67 is low, that is, the engine is operating under a heavy load. At this time, the DC motor 33 is not driven, as is illustrated in FIG. 5 (*b*), and the shut-off valve 29 is in the wide open position, as is illustrated in FIG. 5 (*g*). In addition, at this time, the solenoid 60 of the second electromagnetic valve 59 is de-energized, as is illustrated in FIG. 5 (*c*), and, thus, the vacuum chamber 56 of the recirculation control valve 54 is open to the atmosphere via the second electromagnetic valve 59. As a result, the diaphragm 55 moves toward the atmospheric pressure chamber 57, and, thus, the valve body 61 shuts off the exhaust-gas recirculation passage 53, as is illustrated in FIG. 5 (*h*). Furthermore, at this time, the solenoid 49 of the first electromagnetic valve 47 is de-energized, as is illustrated in FIG. 5 (*d*), and, thus, the vacuum chamber 44 of the bypass control valve apparatus 42 is open to the atmosphere via the first electromagnetic valve 47. As a result, the diaphragm 43 moves toward the atmospheric pressure chamber 45, and, thus, the valve body 51 of the bypass control valve device 42 opens the valve port 50 to the maximum extent, as is illustrated in FIG. 5 (*i*).

On the other hand, in section $T_1$ of FIG. 5, the engine speed is calculated in the MPU 80 (FIG. 4) from the output pulse of the speed sensor 72, and, in addition, the basic fuel injection period is calculated in the MPU 80 from the calculated engine speed and the output signal of the airflow meter 27. In a case wherein the three-way catalytic converter 20 is used, as is illustrated in FIG. 3, when the air-fuel ratio of the fuel mixture fed into the second cylinder group B becomes equal to the stoichiometric air-fuel ratio, the purifying efficiency of the three-way catalytic converter 20 reaches a maximum. Consequently, in the MPU 80, the actual fuel injection period is obtained by correcting the basic fuel injection period on the basis of the output signal of the $O_2$ sensor 21 so that the air-fuel ratio of the fuel mixture fed into the second cylinder group B approaches the stoichiometric air-fuel ratio. Data indicating the actual fuel injection period is written into the output port 84, and the control pulse, corresponding to the data and illustrated in FIG. 5 (*e*) and (*f*), is supplied to the fuel injectors 17*a* of the first cylinder group A and the fuel injectors 17*b* of the second cylinder group B. Consequently, when the engine is operating under a heavy load, fuel is injected from all of the fuel injectors 17*a* and 17*b*.

If the operating state of the engine is changed from a heavy load to a light load at the time $T_a$ in FIG. 5, the output voltage of the vacuum sensor 67 is abruptly increased, as is illustrated in FIG. 5 (*a*). In the MPU 80, when the output voltage of the vacuum sensor 67 exceeds the reference voltage $V_r$ (FIG. 5 (*a*)), it is determined that the engine is operating under a light load. As a result, a drive signal, that is, the continuous pulses illustrated in FIG. 5 (*b*), is supplied to the DC motor 33. At this time, the DC motor 33 rotates at a speed which is proportional to the mean voltage of the continuous pulses. As a result, the shut-off valve 29 is gradually opened, as is illustrated in FIG. 5 (*g*). Then the shut-off valve 29 is closed at the time $T_b$ in FIG. 5. In the MPU 80, if it is determined, on the basis of the output signal of the second comparator 97, that the shut-off valve 29 is closed, various kinds of data, such as data for stopping the injection of fuel by the first fuel injectors 17*a*, data for increasing the amount of fuel injected by the second fuel injectors 17*b*, and data for energizing the solenoids 49 and 60 of the electromagnetic valves 47 and 59, is written into the output port 84. As a result, at the time $T_b$ in FIG. 5 the amount of fuel injected by the fuel injectors 17*b* of the second cylinder group B is increased, as is illustrated in FIG. 5 (*e*), and the injection of fuel by the fuel injectors 17*a* of the first cylinder group A is stopped, as is illustrated in FIG. 5 (*f*). In addition, since the solenoid 49 of the first electromagnetic valve 47 is energized, the vacuum chamber 44 of the bypass control valve apparatus 42 is connected to the second surge tank 12 via the vacuum conduit 48. As a result, the diaphragm 43 moves toward the vacuum chamber 44, and, thus, the valve body 51 closes the valve port 50, as is illustrated in FIG. 5 (*i*). Furthermore, at the time $T_b$ in FIG. 5, since the solenoid 60 of the second electromagnetic valve 59 is energized, as mentioned above, the vacuum chamber 56 of the recirculation control valve 54 is connected to the second surge tank 12 via the vacuum conduit 48. As a result, since the diaphragm 55 moves toward the vacuum chamber 56, the valve body 61 opens the exhaust-gas recirculation passage 53. This valve body 61 opens to the maximum extent at the time $T_c$ in FIG. 5.

As mentioned above, since the valve body 51 shuts off the bypass pipe 37 as soon as the valve body 61 of the recirculation control valve 54 opens the exhaust-gas recirculation passage 53, there is no danger of the exhaust gas, which flows into the first surge tank 11 from the exhaust-gas recirculation passage 53, flowing into the second surge tank 12.

In FIG. 6, the time $T_d$ indicates the time at which the operating state of the engine is changed from a light load to a heavy load. AT this time, since the solenoid 60 of the second electromagnetic valve 59 is de-energized, as is illustrated in FIG. 6 (*c*), the valve body 61 of the recirculation control valve 54 shuts off the exhaust-gas recirculation passage 53, as is illustrated in FIG. 6 (*h*). When the valve body 61 completely shuts off the exhaust-gas recirculation passage 53 and, thus, the movable contact 64 of the valve position switch 63 comes into contact with the stationary contact 65, various types of data, such as data for starting the injection of fuel by the first fuel injectors 17*a*, as is illustrated in FIG. 6 (*f*), data for driving the DC motor 33, as is illustrated in FIG. 6 (*b*), and data for energizing the solenoid 49 of the first electromagnetic valve 47, as is illustrated in FIG. 6 (*i*), is written into the output port 84. Consequently, when the valve body 61 of the recirculation control valve 54 completely shuts off the exhaust-gas recirculation passage 53, the injection of fuel by the first fuel injectors 17*a* is started, as is illustrated in FIG. 6 (*f*). In addition, at this time, the shut-off valve 29 gradually opens, as is illustrated in FIG. 6 (*g*), and the valve body 51 of the bypass control valve apparatus 42 instantaneously opens.

According to the present invention, since the shut-off valve 29 is driven by the DC motor 33, it is possible to slowly open and close the shut-off valve 29. Consequently, when the operating state of the engine is changed from a light load to a heavy load, or from a heavy load to a light load, the output torque of the engine is not abruptly changed. This makes it possible to obtain a good drivability of a vehicle. In addition, since the DC motor 33, the reduction gear, the stop mechanism and the valve position sensor 32 can be integrally assembled into the housing 100, it is possible to minimized the size of the drive apparatus 31.

While the invention has been described with reference to specific embodiment chosen for the purpose of illustration, it is apparent that numerous modifications could be made thereto by those skilled in the art without departing from the basic concept and scope of the invention.

We claim:

1. A split engine having a plurality of cylinders which are divided into a first cylinder group and a second cylinder group, said engine comprising:

a first intake passage having an inlet and an outlet connected to said first cylinder group;

a second intake passage having an inlet and an outlet connected to said second cylinder group, the inlet of said first intake passage being connected to said second intake passage and the inlet of said second intake passage being open to the outside air;

an exhaust passage connected to said first cylinder group;

a manually operated throttle valve arranged in the inlet of said second intake passage;

detecting means for detecting the level of the load of the engine and for producing an output signal;

electronic control means for producing control signals in response to the output signal of said detecting means;

fuel supply means, actuated in response to a control signal of said electronic control means, for feeding fuel into only said second cylinder group when the level of the load of the engine is lower than a predetermined level and for feeding fuel into both of said cylinder groups when the level of the load of the engine is higher than the predetermined level;

an exhaust-gas recirculation passage interconnecting said exhaust passage to said first intake passage;

a recirculation control valve, arranged in said exhaust-gas recirculation passage, for controlling the flow area of said exhaust-gas recirculation passage;

actuating means operated in response to a control signal of said electronic control means and opening said recirculation control valve when the level of the load of the engine is lower than the predetermined level;

a shut-off valve, arranged in the inlet of said first intake passage, for controlling the flow area of the inlet of said first intake passage; and a drive apparatus operated in response to a control signal of said electronic control means and having therein a DC motor which actuates said shut-off valve for opening it when the level of the load of the engine becomes higher than the predetermined level.

2. A split engine according to claim 1, wherein said drive apparatus comprises a housing, a shut-off valve shaft rotatably supported in said housing and having a first end and a second end, a worm wheel arranged in said housing and fixed onto the first end of said shut-off valve shaft, a valve position sensor arranged in said housing and fixed onto the second end of said shut-off valve shaft for detecting the position of said shut-off valve, and a worm gear arranged in said housing and engaging with said worm wheel, said DC motor being supported by said housing and having an output shaft to which said worm gear is fixed.

3. A split engine according to claim 2, wherein said drive apparatus comprises a sector-shaped arm arranged in said housing and fixed onto the first end of said shut-off valve shaft at a position adjacent to said worm wheel, and a stop member arranged in and fixed onto said housing and being engageable with said arm for retaining said shut-off valve at the closed position or the wide open position.

4. A split engine according to claim 3, wherein said sector-shaped arm has opposing end portions, and said stop member comprises an approximately semi-circular base portion fixed onto said housing by bolts, and opposing end portions bent outwardly from said base portion towards said worm wheel and being engageable with the corresponding opposing end portions of said arm.

5. A split engine according to claim 2, wherein said valve position sensor has a U-shaped arm which is rotatable around an axis of said shut-off valve shaft, said shut-off valve shaft having a U-shaped arm which is fixed onto the second end thereof and is in engagement with the U-shaped arm of said valve position sensor for actuating said valve position sensor.

6. A split engine according to claim 1, wherein said electronic control means produces continuous drive pulses for driving said DC motor.

7. A split engine according to claim 1, wherein said actuating means comprises a valve position switch which is actuated in response to the movement of said recirculation control valve and which produces an output signal indicating that said recirculation control valve closes, said DC motor actuating said shut-off valve in response to the output signal of said valve position switch for starting the operation of opening said shut-off valve after said recirculation control valve closes.

8. A split engine according to claim 7, wherein said actuating means comprises a vacuum-operated diaphragm apparatus having a diaphragm, said valve position switch being operated in response to the movement of said diaphragm.

9. A split engine according to claim 1, wherein said drive apparatus comprises a valve position sensor for detecting the position of said shut-off valve and for producing an output signal indicating that said shut-off valve closes, said actuating means actuating said recirculation control valve in response to the output signal of said valve position sensor for starting the operation of opening said recirculation control valve after said shut-off valve closes.

10. A split engine according to claim 1, wherein said detecting means is a vacuum sensor arranged in said second intake passage for detecting the level of vacuum in said second intake passage.

11. A split engine according to claim 1, wherein said fuel supply means comprises a first group of injectors arranged in said first intake passage and a second group of injectors arranged in said second intake passage.

12. A split engine according to claim 1, wherein said engine comprises a bypass passage interconnecting said first intake passage to said second intake passage and a bypass control valve arranged in said bypass passage and actuated in response to a control signal of said electronic control means for shutting off said bypass passage when said recirculation control valve opens.

13. A split engine according to claim 12, wherein said actuating means comprises a valve position switch which is actuated in response to the movement of said recirculation control valve and which produces and output signal indicating that said recirculation control valve closes, said bypass control valve opening in response to the output signal of said valve position switch when said recirculation control valve closes.

14. A split engine according to claim 12, wherein said drive apparatus comprises a valve position sensor for detecting the position of said shut-off valve and for producing an output signal indicating that said shut-off valve closes, said bypass control valve shutting off said bypass passage when said shut-off valve closes.

15. A split engine according to claim 12, wherein said bypass control valve comprises a vacuum-operated diaphragm apparatus.

16. A split engine according to claim 12, wherein said engine comprises an auxiliary air supply passage interconnecting said bypass passage to the inlet of said second intake passage, which is located upstream of said throttle valve.

17. A split engine according to claim 16, wherein said auxiliary air supply passage has a control valve arranged therein for maintaining the engine speed at a predetermined speed at idle.

* * * * *